US007181870B2

(12) United States Patent
Guzman

(10) Patent No.: US 7,181,870 B2
(45) Date of Patent: Feb. 27, 2007

(54) FOOTWEAR WITH BLACK LIGHT LED

(75) Inventor: Rudy Guzman, Coral Springs, FL (US)

(73) Assignee: BBC International, Ltd., Boca Raton, FL (US)

( * ) Notice: Subject to any disclaimer, the term of this patent is extended or adjusted under 35 U.S.C. 154(b) by 83 days.

(21) Appl. No.: 11/071,000

(22) Filed: Mar. 3, 2005

(65) Prior Publication Data

US 2006/0196089 A1 Sep. 7, 2006

(51) Int. Cl.
*A43B 23/00* (2006.01)
*F21V 21/08* (2006.01)

(52) U.S. Cl. ..... 36/137; 362/103

(58) Field of Classification Search ..... 36/137
See application file for complete search history.

(56) References Cited

U.S. PATENT DOCUMENTS 3,291,668 A * 12/1966 Goldstein ..... 36/1
5,136,726 A * 8/1992 Kellin et al. ..... 2/244
5,408,764 A 4/1995 Wut ..... 36/137
5,577,828 A * 11/1996 Nadel et al. ..... 362/103
5,857,273 A 1/1999 Rapisarda ..... 36/137
5,969,479 A 10/1999 Wong ..... 315/200 A
6,764,193 B1 7/2004 Wei ..... 362/103
2003/0231513 A1 12/2003 Wei ..... 362/570
2004/0264173 A1* 12/2004 Vanderschuit ..... 362/103

* cited by examiner

*Primary Examiner*—Ted Kavanaugh
(74) *Attorney, Agent, or Firm*—GrayRobinson, P.A.

(57) ABSTRACT

This invention is directed to an article of footwear or other article of clothing in which designs containing phosphors are located on the article is the path of ultraviolet radiation emitted from one or more black light LEDs causing the designs to glow.

3 Claims, 4 Drawing Sheets

FOOTWEAR WITH BLACK LIGHT LED

FIELD OF THE INVENTION

This invention relates to articles of footwear, and, more particularly, to a shoe having one or more black light LEDs operative to direct ultraviolet light over one or more designs containing phosphors which are located on the outsole and/or upper of the shoe causing the designs to glow.

BACKGROUND OF THE INVENTION

For a number of years, articles of footwear and various items of clothing have been sold with decorative arrays of light sources such as light emitting diodes (LEDs). This has been particularly popular in children's footwear where the LEDs are arranged to complement other design elements of the shoe, including cartoon characters and the like.

LEDs are used in a variety of ways in children's shoes to create different visual effects. For example, one or more LEDs may be mounted at one end of a clear polymer strip formed with etchings or other designs on its inner and/or outer surfaces. The polymer strip is effective to transmit the light emitted by the LED from one end toward the other, and the etchings or other surface markings on the strip reflect the light in a desired pattern. See U.S. Pat. No. 5,857,273.

Other visual effects are obtained using LEDs of different colors and/or varying how the LEDs are illuminated. LEDs are currently available in red, green, blue and white. Designers often employ LEDs of one or more colors arranged in designs located on the upper of the shoe or its outsole to obtain a desired effect. More recently, color mixing LEDs have been proposed in which primary color chips of red, green and blue are arranged side-by-side in a housing and selectively illuminated for a predetermined time period to produce other colors. For example, combining red and green light produces purple, and orange light is produced by combining red and green. See U.S. Pat. No. 6,764,193 and U.S. Patent Application Publication US 2003/0231513.

With respect to illumination of LEDs in shoes and other articles of clothing, a typical design includes a module having a battery, a switch, and, conventionally, an integrated circuit ("IC"). The IC is connected by wires to LEDs positioned along the outsole, upper or tongue of the shoe, or at a desired location on another article of clothing. The IC is effective to turn on and off the LEDs, often in a flashing sequence, to enhance the visual effect and draw attention to the shoe or other article of clothing. In many designs, the IC is enabled by a switch operative in response to motion or pressure.

SUMMARY OF THE INVENTION

In one embodiment, this invention is directed to an article of footwear in which designs appearing on the outsole and/or upper of the shoe are exposed to ultraviolet light emitted from one or more black light LEDs to produce a unique visual effect.

The article of footwear of this invention takes advantage of the fluorescent properties of phosphors. Phosphors are substances that fluoresce when exposed to ultraviolet radiation, and are present in some paints, fabrics and plastics. In the present invention, one or more designs which contain phosphors are "painted" or otherwise applied to the outsole and/or upper of the article of footwear. Additionally, the material forming the outsole, the laces and/or other white-colored portions of the article of footwear may contain phosphors. When exposed to emissions from one or more "black light" LEDs, these designs and white areas of the footwear fluoresce while the surrounding areas are unaffected thus producing a unique visual effect.

Sunlight and specially designed artificial lights produce ultraviolet radiation in three bands according to wavelength, e.g. UVA (320–400 nanometers), UVB (280–320 nanometers) and UVC (below 280 nanometers). Black light LEDs are provided with filters which allow relatively benign UVA light, and some blue and violet visible light, to pass through while absorbing everything else. Items containing phosphors which are placed in the path of emissions from black light LEDs give off visible white light, e.g. a "glow," and this results in a striking effect when used in shoes and other articles of clothing according to the present invention.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Referring now to the FIGS., a shoe 10 is shown having an outsole 12 connected to an upper 14. It should be understood that any other article of footwear is considered within the scope of this invention, and the shoe 10 is shown for purposes of illustration. As such, the term "upper" is meant to broadly encompass essentially any shoe element mounted to the outsole of an article of footwear such as the straps of a sandal, etc.

Figure 1:
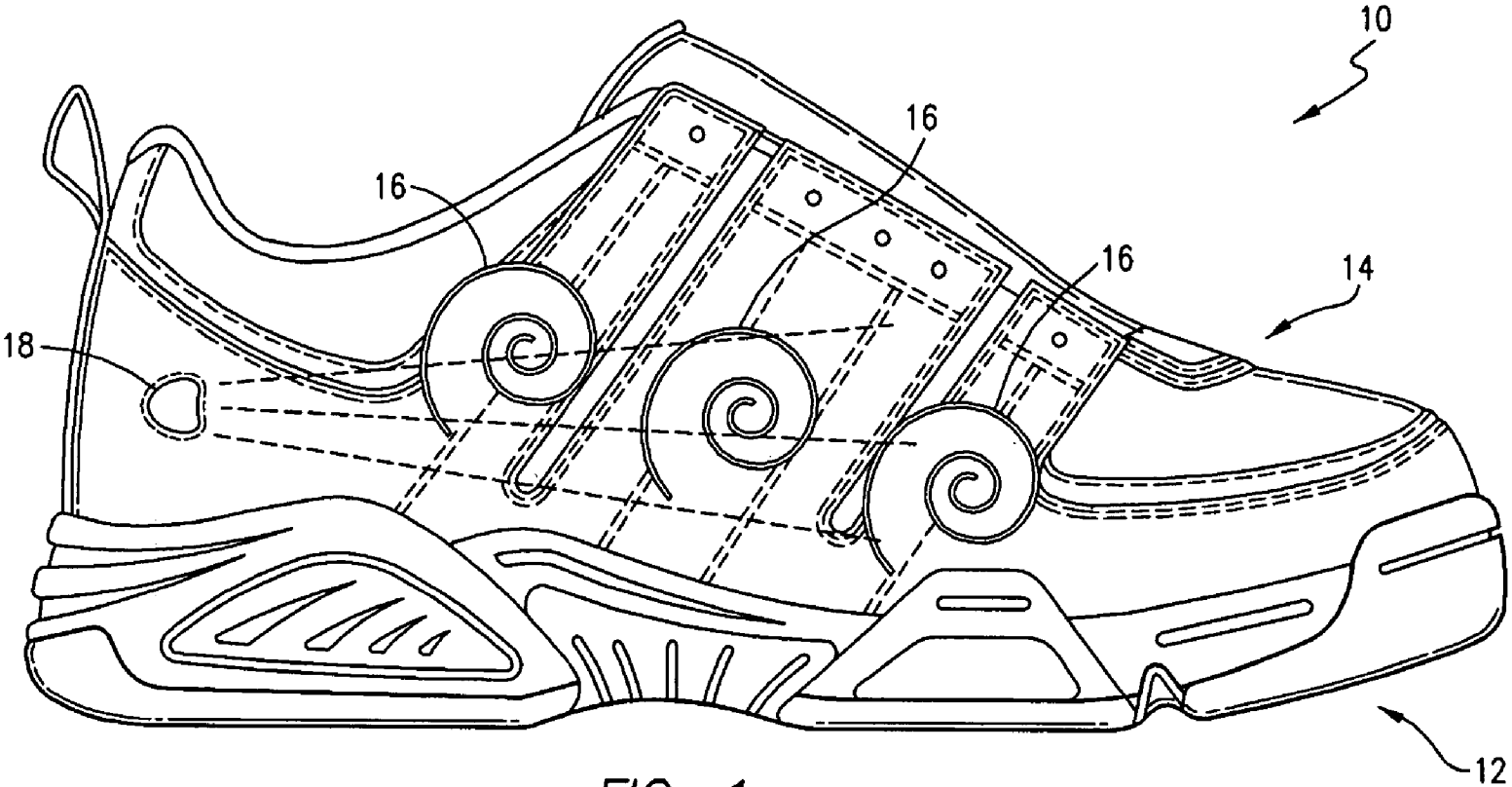
FIG. 1 is a side view of a shoe having a design containing phosphors located on the shoe upper in the path of emissions from a black light LED.

In the embodiment of FIG. 1, a variety of generally spiral-shaped design elements 16 are applied to the upper 14 of the shoe 10 in the path of emissions (dotted lines) from a black light LED 18 mounted in the heel area. For purposes of this discussion, the design elements 16, and those described below in connection with a description of FIGS. 2-4, may be in the form of fluorescent-colored shapes, sections of paint, fabric or plastic, or essentially any other materials arranged in a decorative pattern, each containing phosphors so as to fluoresce when exposed to ultraviolet radiation. The black light LED 18 may be mounted in a protective housing (not shown) formed of plastic or the like which orients the black light LED 18 at the appropriate angle to emit ultraviolet radiation over the design elements 16.

Figure 2:
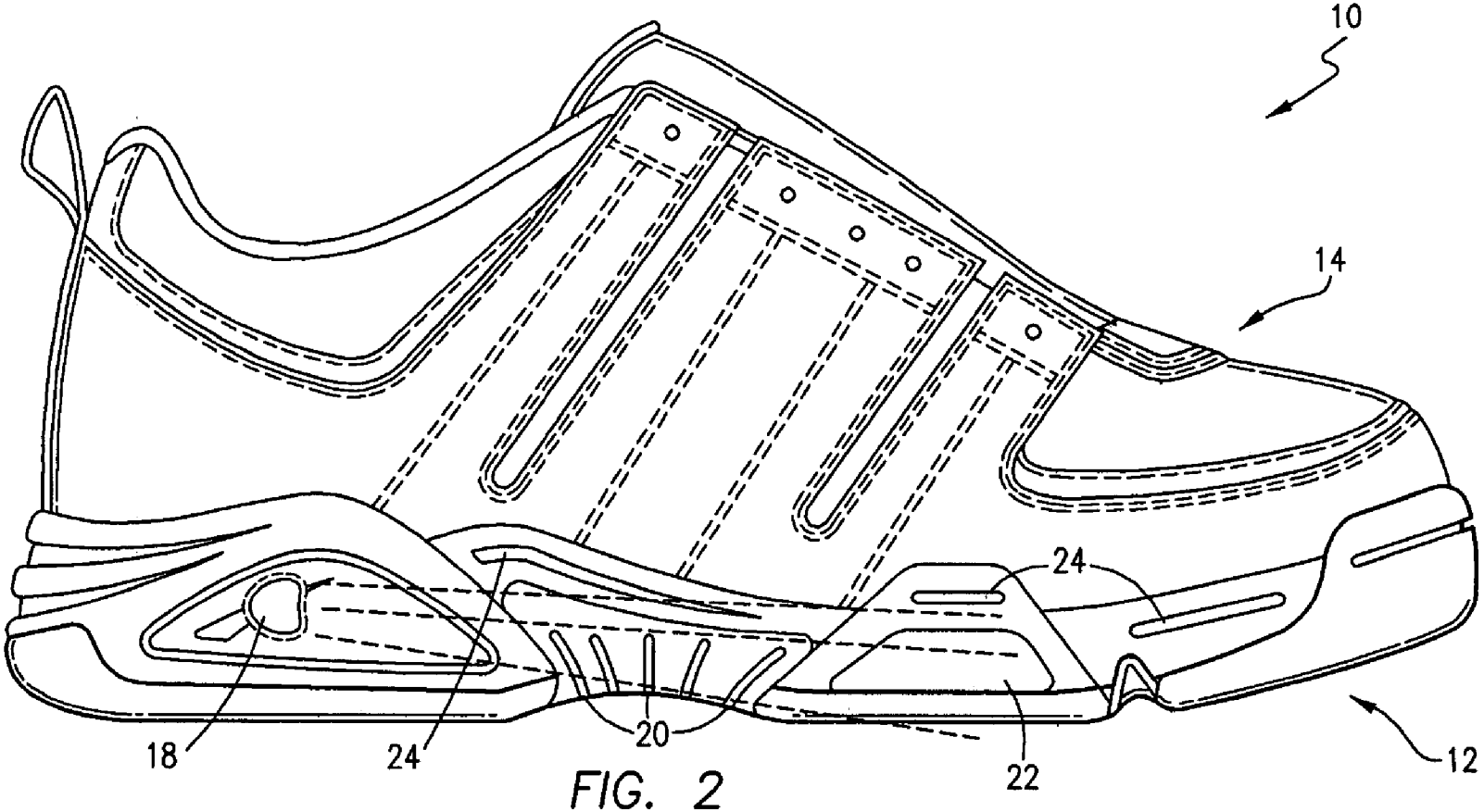
FIG. 2 is view similar to FIG. 1 except where the designs, and the black light LED, are located on the outsole of the shoe.
Figure 4:
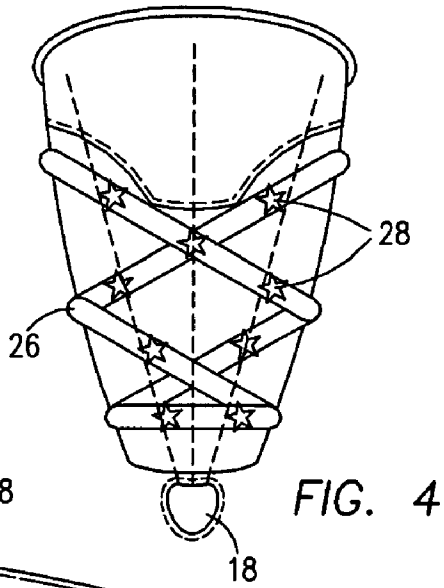
FIG. 4 is an enlarged view of the tongue area of the shoe depicted in FIG. 3 illustrating the design elements on the shoe laces.
Figure 3:
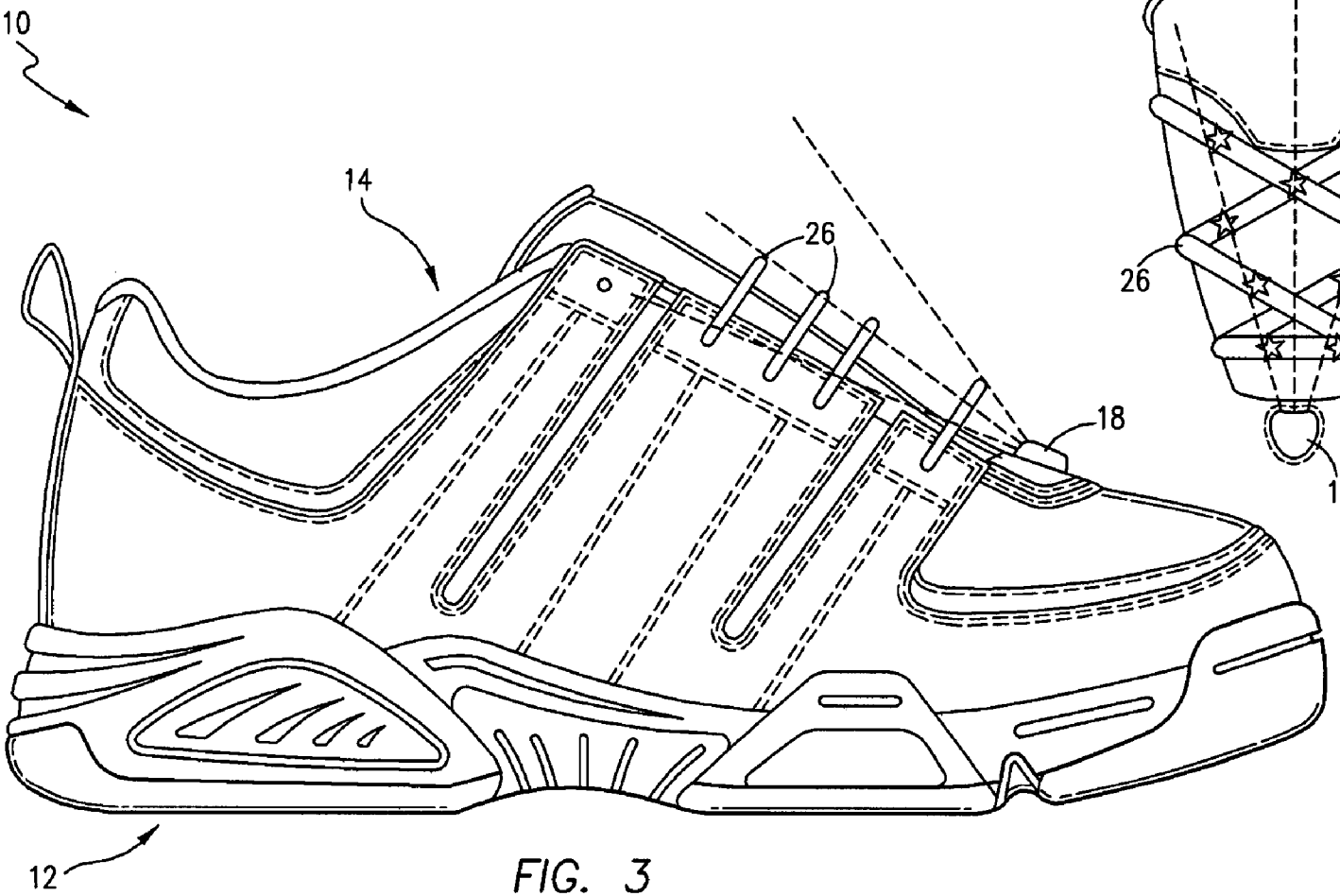
FIG. 3 is a view similar to FIGS. 1 and 2 except where the black light LED is positioned to illuminate the laces of the shoe which are provided with design elements containing phosphors.

FIGS. 2–4 depict alternative arrangements of the black light LED 18 and design elements according to this invention. In FIG. 2, the outsole 12 is provided with a number of design elements in the form of a series of stripes 20, blocks 22, lines 24 and the like, which may be fluorescent-colored paint, all applied to the outsole 12. Portions of the outsole 12 in between the stripes 20 and blocks 22 are colored white but also may contain phosphors thus adding to the visual effect when irradiated by the black light LED 18.

The embodiment of FIGS. 3 and 4 illustrates white shoelaces 26 which are provided with a decorative array of designs 28, preferably in the form of fluorescent-colored paint. Both the shoelaces 26 and designs 28 fluoresce when exposed to ultraviolet radiation emitted from a black light LED 18 located at the base of the tongue of the shoe 10, as shown.

Figure 5:
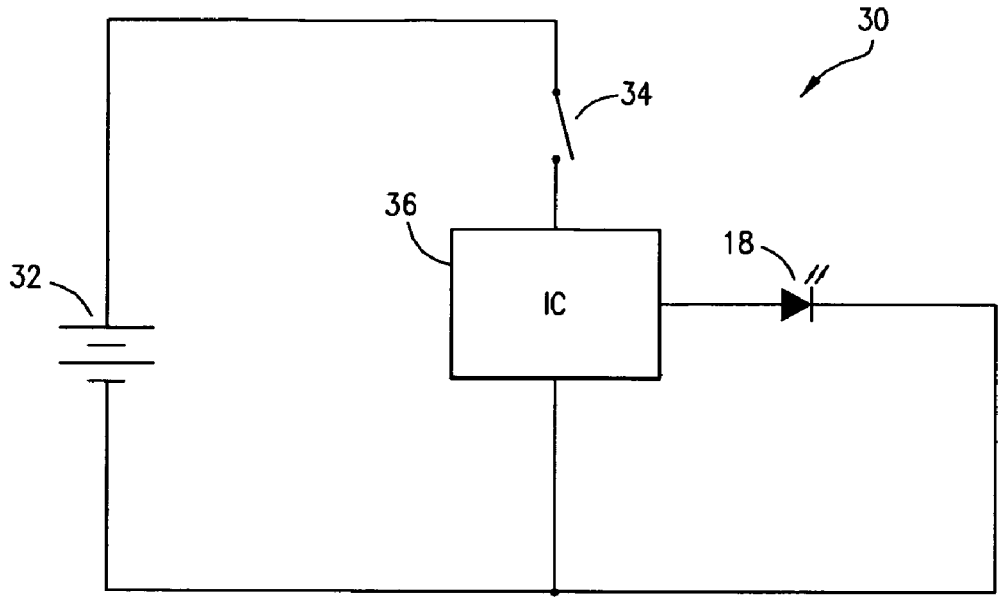
FIG. 5 is a schematic circuit diagram of one embodiment of an electrical circuit suitable for use with the shoe of this invention.

Referring to FIG. 5, one electrical circuit 30 which may be employed to illuminate the black light LEDs 18 in each of the embodiments of FIGS. 1–4 is schematically shown. The circuit 30 includes a battery 32 coupled to an inertia switch 34 which is operative to activate an IC 36 coupled to the black light LED 18 by wires (not shown). One type of inertia switch 34 suitable for use in the circuit 30 is disclosed in U.S. Pat. No. 5,408,764. The IC 36 is available under part number 6608 from Cheerine Development (Hong Kong) Ltd., having a place of business at Room 1217, North Tower, Concordia Plaza, No. 1 Science Museum Road, Tsim Sha Tsui East, Kowloon, Hong Kong. When activated by movement of the inertia switch 34 to a closed position, the IC 36 is effective to illuminate the black light LED 18 in a flashing pattern. Alternatively, the inertial switch 34 and IC 36 may be eliminated and replaced by a manually operated on/off switch (not shown) coupled to the battery 32 and black light LED 18. Additionally, the circuit 30 may be replaced with one such as shown, for example, in U.S. Pat. No. 5,969,479.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, the FIGS. depict one or more black light LEDs mounted to a shoe having designs containing phosphors located in the path of ultraviolet radiation emitted from the black light LED(s). It should be understood that the combination of one or more black light LEDs 18, the electrical circuit 30 and the designs 16, 20, 22, 24 and/or 28 could be employed in articles of clothing other than footwear.

Therefore, it is intended that the invention not be limited to the particular embodiment disclosed as the best mode contemplated for carrying out this invention, but that the invention will include all embodiments falling within the scope of the appended claims.

I claim:

1. An article of footwear, comprising:

an outsole connected to an upper, each of said outsole and said upper having an exposed exterior surface, at least one of said upper and said outsole having at least one design element containing phosphors located on said exterior surface thereof;

at least one source of black light operative to emit ultraviolet light, said at least one source of black light being mounted to said exposed exterior surface of at least one of said upper and said outsole in position so that said ultraviolet light emitted by said at least one source of black light travels exteriorly of said upper and said outsole and shines on said at least one design element causing it to glow;

an electrical circuit including a battery coupled to an inertia switch, to an integrated circuit and to said at least one black light, said integrated circuit being operative in response to activation of said inertia switch to illuminate said at least one black light in a flashing pattern.

2. The article of footwear of claim 1 in which said design elements include at least a portion of said outsole which has a white color and contains phosphors.

3. The article of footwear of claim 1 in which said upper includes shoelaces, said shoelaces containing phosphors and being marked with a pattern of fluorescent colors containing phosphors, said shoelaces and fluorescent colors glowing when exposed to the ultraviolet light from said at least one source of black light.

* * * * *